US006504940B2

(12) United States Patent
Omata et al.

(10) Patent No.: US 6,504,940 B2
(45) Date of Patent: Jan. 7, 2003

(54) CONNECTING DEVICE FOR CONNECTING A SOUND PRODUCING DEVICE TO AN ELECTRONIC EQUIPMENT

(75) Inventors: Hajime Omata, Fujiyoshida (JP); Shunichi Watanabe, Fujiyoshida (JP); Atsushi Kuwabara, Fujiyoshida (JP); Yoshizumi Ohta, Fujiyoshida (JP)

(73) Assignee: Citizen Electronics Co., Ltd., Fujiyoshida (JP)

( * ) Notice: Subject to any disclaimer, the term of this patent is extended or adjusted under 35 U.S.C. 154(b) by 0 days.

(21) Appl. No.: 09/741,051

(22) Filed: Dec. 21, 2000

(65) Prior Publication Data

US 2001/0004398 A1 Jun. 21, 2001

(30) Foreign Application Priority Data

Dec. 21, 1999 (JP) ..... 11-363525

(51) Int. Cl.[7] ..... H04R 25/00

(52) U.S. Cl. ..... 381/409; 381/386; 381/410; 439/495

(58) Field of Search ..... 381/409, 410, 381/386, 394, 396; 439/495, 260, 329

(56) References Cited

U.S. PATENT DOCUMENTS

| | | | | | |
|---|---|---|---|---|---|
| 3,609,652 | A | * | 9/1971 | Sebastian | 381/409 |
| 5,365,268 | A | | 11/1994 | Minami | 348/76 |
| 5,904,589 | A | | 5/1999 | Asakawa | 439/495 |
| 5,928,029 | A | | 7/1999 | Lam | 439/495 |
| 6,089,904 | A | * | 7/2000 | Wu | 439/495 |
| 6,238,238 | B1 | * | 5/2001 | Hwang et al. | 439/495 |

FOREIGN PATENT DOCUMENTS

| | | |
|---|---|---|
| GB | 1018682 | 2/1966 |

* cited by examiner

*Primary Examiner*—Huyen Le
(74) *Attorney, Agent, or Firm*—Birch, Stewart, Kolasch & Birch, LLP

(57) ABSTRACT

A connecting device for connecting a sound producing device to an electronic equipment has a connector secured to the sound producing device, and having a pair of elastic contacts and an opening. A slider is provided to be inserted in the connector from the opening, and provided to press the elastic contacts of the connector against terminals of a substrate inserted in the connector from the opening.

1 Claim, 7 Drawing Sheets

CONNECTING DEVICE FOR CONNECTING A SOUND PRODUCING DEVICE TO AN ELECTRONIC EQUIPMENT

BACKGROUND OF THE INVENTION

The present invention relates to a connecting device for electrically connecting a sound producing device to an electronic equipment such as a portable telephone.

The sound producing device for the portable telephone is mounted in the portable telephone, and a coil of a buzzer or a speaker is connected to a circuit in the telephone.

FIG. 7 shows a conventional device for connecting a sound producing device to an electronic equipment. A manufacturer A manufactures the sound producing device 1 having a pair of leads 2 and a connector comprising a plug 3 and a socket 4. A coil of the sound producing device 1 is connected to a circuit of a substrate 5 of a portable telephone through the leads 2 and the plug 3 and socket 4 by a telephone manufacturer B who bought the device 1.

The sound producing device 1 of FIG. 8 is connected to the circuit of the substrate 5 by a pair of spring plates 6 by the manufacturer B.

The sound producing device 1 shown in FIG. 9 is connected to the circuit on the substrate by a pair of coil springs 7.

In the device 1 of FIG. 7, the number of parts comprising the leads 2, plug 3 and socket 4 is large, and a large number of manufacturing steps are required.

In the device of FIG. 8 or 9, the manufacturer B must solder the spring plates 6 or coil springs 7 to the circuit of the substrate 5.

SUMMARY OF THE INVENTION

An object of the present invention is to provide a connecting device which may easily connect a sound producing device to an electronic equipment.

According to the present invention, there is provided a connecting device for connecting a sound producing device to an electronic equipment comprising a connector secured to the sound producing device, and having a pair of elastic contacts and an opening, a slider to be inserted in the connector from the opening, and being provided to press the elastic contacts of the connector against terminals of a substrate inserted in the connector from the opening.

Each of the elastic contacts is a cantilever embedded in the connector at a base thereof, and extended in an inserting direction of the slider, and has contacting projection upwardly projected at a front end portion.

The slider has a pressure portion and an introducing portion adjacent to the pressure portion having an upward slant formed on the underside thereof, the introducing portion is provided to form a gap between the elastic contact at a substrate introducing position for introducing the substrate therein.

These and other objects and features of the present invention will become more apparent from the following detailed description with reference to the accompanying drawings.

DETAILED DESCRIPTION OF THE PREFERRED EMBODIMENT

Figure 1A:
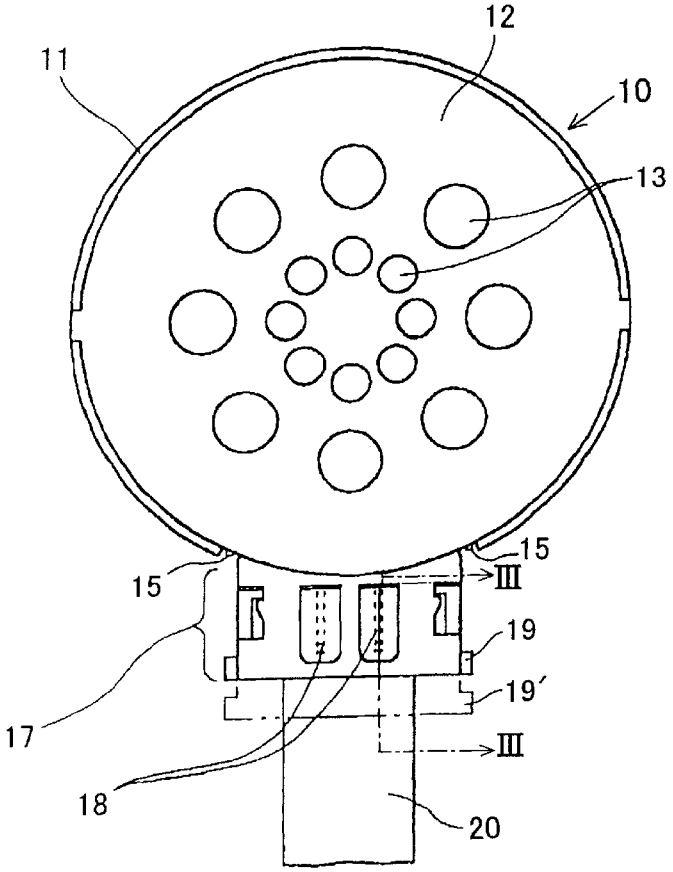
FIG. 1*a* is a plan view of a sound producing device having a connecting device of the present invention.
Figure 1B:
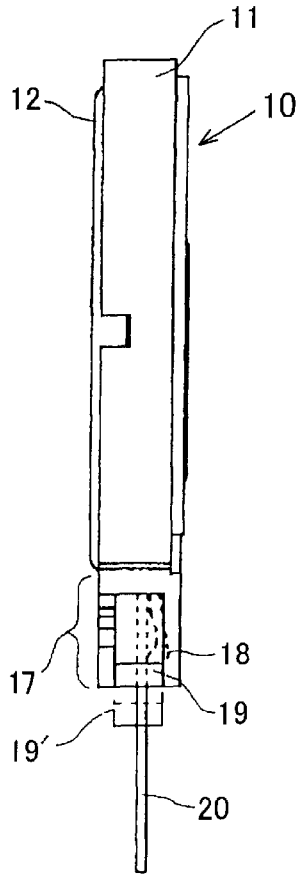
FIG. 1*b* is a side view of the device.
Figure 1C:
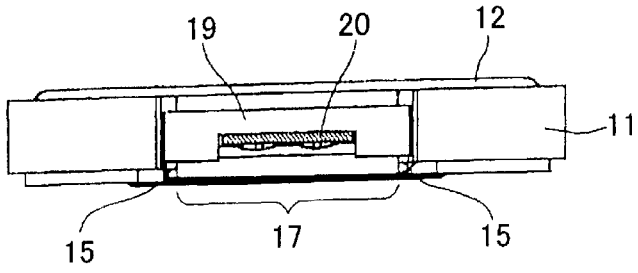
FIG. 1*c* is a front view of the device.
Figure 2:
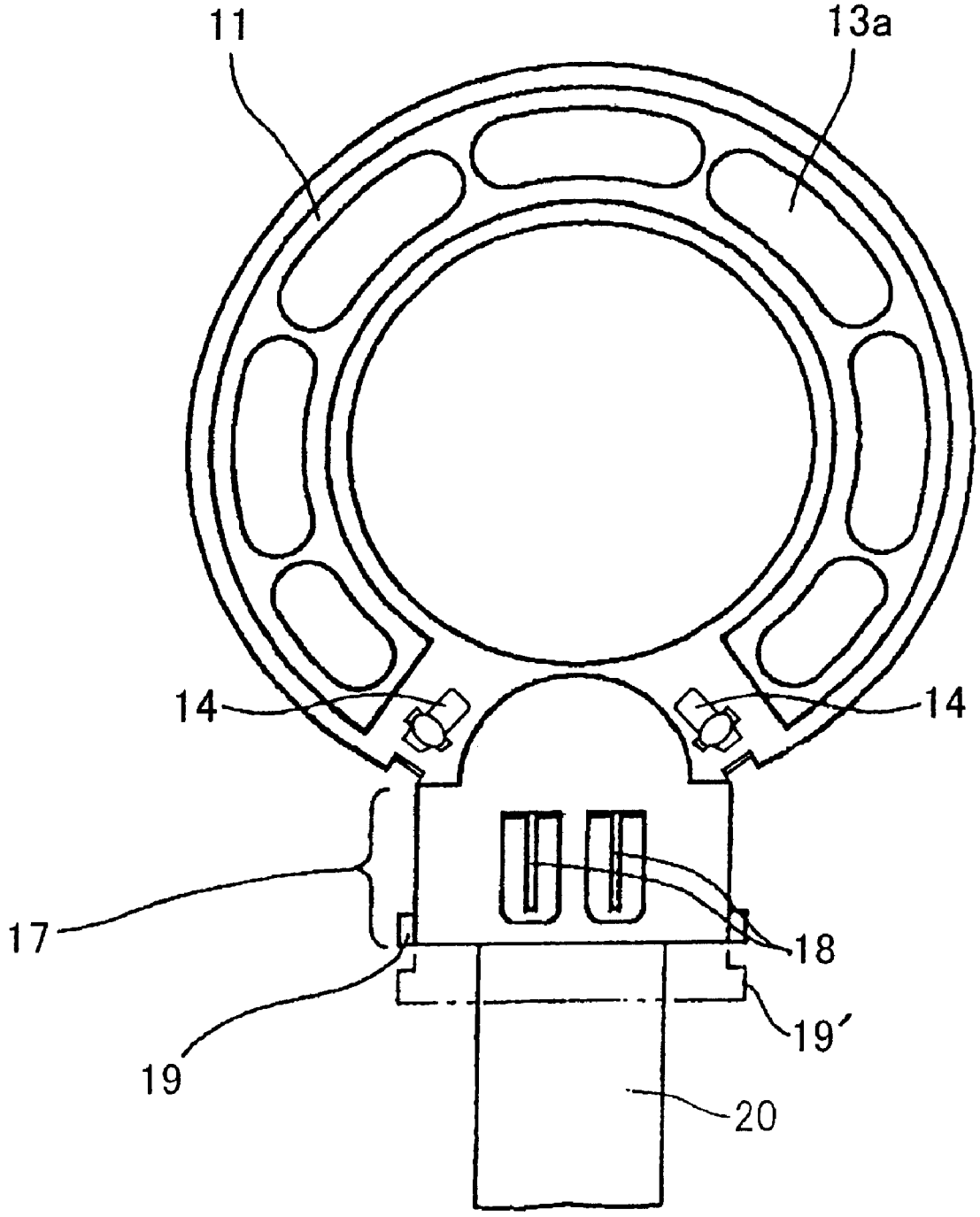
FIG. 2 is a plan view showing the underside of the device.

Referring to FIGS. 1*a* to 1*e* and FIG. 2, a sound producing device 10 has a case 11 and a cover 12 which are made of plastic. The cover 12 has a plurality of sound discharge holes 13, and the underside of the case 11 also has a plurality of sound discharge hole 13*a* as shown in FIG. 2.

A connector 17 according to the present invention is integrated with the case 11 at the molding of the case 11.

Figure 3A:
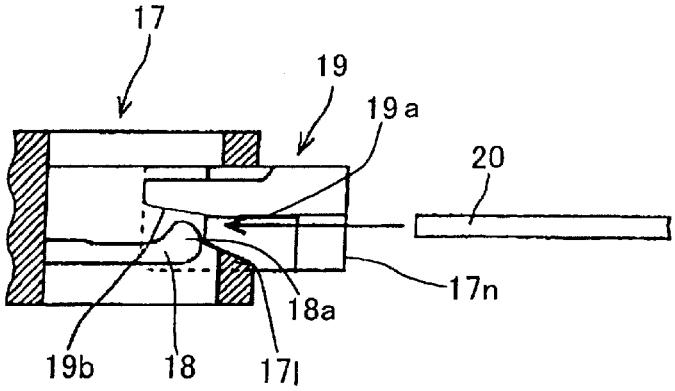
FIGS. 3*a* and 3*b* are sectional views taken along a line III of FIG. 1*a*, respectively.

Referring to FIGS. 3*a* through 4*e*, the connector 17 has a box shape comprising an upper plate 17*a*, lower plate 17*b*, side plates 17*c*, 17*d* and rear plate 17*m*. In the front of the connector 17, an insertion opening 17*n* is formed. The upper plate 17*a* has a pair of windows 17*e*, and the lower plate 17*b* has a pair of windows 17*f*. A pair of cantilever elastic contacts 18 made of elastic metal are embedded in the rear plate 17*m* at the molding of the connector 17 and appear in the windows 17*e*. Each of the elastic contacts 18 has a contacting projection 18*a* upwardly projected at a front end portion and extends in an insertion direction of a slider 19 (FIG. 3).

Figure 4A:
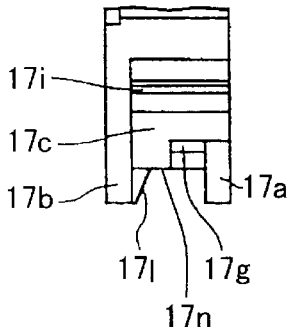
FIG. 4*a* is a left side view of a connector.
Figure 4B:
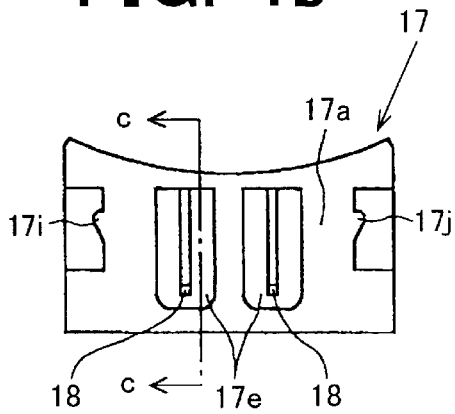
FIG. 4*b* is a plan view of the connector.

On the outer walls of the side plates 17*c* and 17*d*, there is formed hooks 17*g* and 17*h*, and rib projections 17*i* and 17*j*, respectively. Each of the hooks and rib projections are arranged in the slider insertion direction. As shown in FIG. 4*a*, each of the hooks 17*g* and 17*h* is positioned at a position in an upper half location. Each of the rib projections 17*i* and 17*j* is elongated a whole height of the side plate 17*c* (17*d*).

Figure 3B:
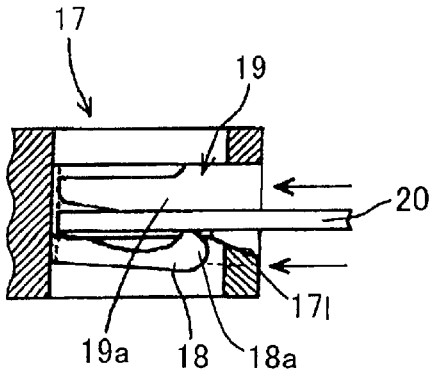
Figure 4C:
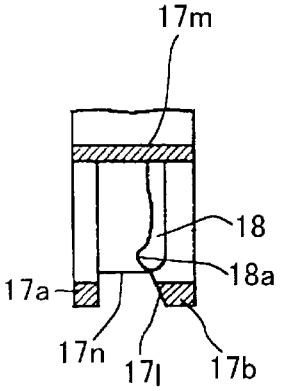
FIG. 4*c* is a sectional view taken along a line c—c of FIG. 4*b;*
Figure 4D:
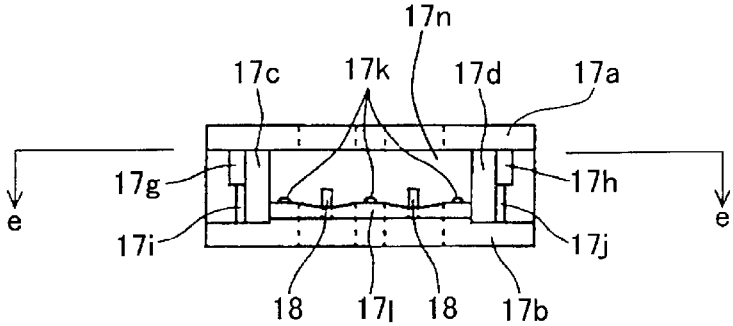
FIG. 4*d* is a front view of the connector.
Figure 4E:
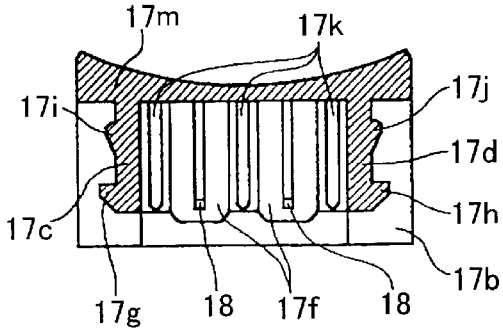
FIG. 4*e* is a sectional view taken along a line e—e of FIG. 4*d;*

Referring to FIGS. 4*d* and 4*e*, three guide ribs 17*k* are provided on the lower plate 17*b*, extending in the slider insertion direction for guiding a flexible substrate 20 (FIG. 3). As shown in FIGS. 4*a* and 4*c*, there is formed a slant 17*l* on the lower plate 17*b* at the opening 17*n* for guiding the insertion of the flexible substrate 20.

Referring to FIG. 2, on the underside of the case 11 a pair of terminals 14 are embedded in the case and connected to ends of a coil of a buzzer provided in the case 11. Each of the elastic contacts 18 and the corresponding terminal 14 are formed from a metal plate including intermediate lead so as to be connected through the intermediate lead.

Referring to FIGS. 5*a* to 5*d* the slider 19 comprises a pressure portion 19*a*, an introducing portion 19*b*, adjacent the pressure portion 19*a* having an upward slant formed on the underside thereof, and a pair of side plates 19*c* and 19*d* confronting the opposite sides of the pressure portion 19*a*.

Figure 5A:
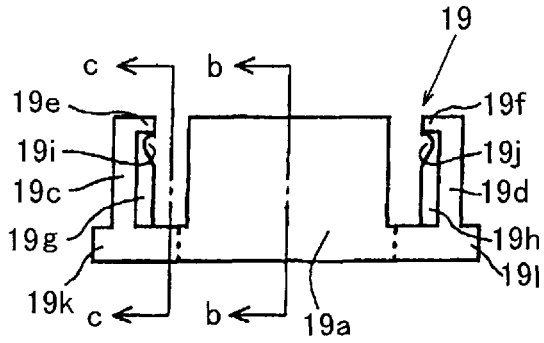
FIG. 5*a* is a plan view of a slider.
Figure 5B:
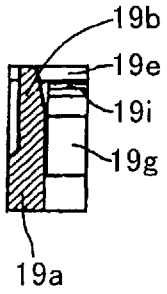
FIG. 5*b* is a sectional view taken along a line b—b of FIG. 5*a;*
Figure 5C:
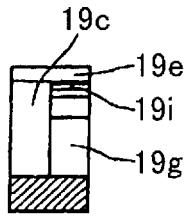
FIG. 5*c* is a sectional view taken along a line c—c of FIG. 5*a;*
Figure 5D:
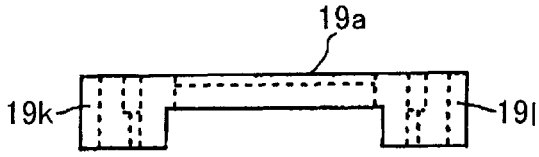
FIG. 5*d* is a front view of the slider.

As shown in FIG. 5*b*, the pressure portion 19*a* is positioned in an upper half range. On inside walls of the side plates 19*c* and 19*d*, hooks 19*e* and 19*f*, ribs 19*g* and 19*h* extending from the hooks are formed. These portions 19*e*, 19*f*, 19*g* and 19*h* are positioned in a lower half range as shown in FIGS. 5*b*, 5*c*. On both sides of the base portion of the slider 19, projections 19*k* and 19*l* are provided, outwardly projecting as a pair of knobs for extracting the slider 19 from the connector 17.

The connector 17 and the slider 19 are supplied to a portable telephone manufacturer. The substrate 20 is inserted in the connector 17 by the manufacturer.

Referring to FIGS. 6*a* through 6*e* showing the inserting operation of the slider 19, the slider 19 is inserted in the connector 17 from the opening 17*n*. At the hooks 17*g* and 17*h*, the side plates 19*c* and 19*d* are expanded by the engagement of the hooks 19*e* and 19*f*, so that the hooks 19*e* and 19*f* of the slider 19 get over the hooks 17*g* and 17*h* and enter substrate introducing positions 17*p*.

Figure 6A:
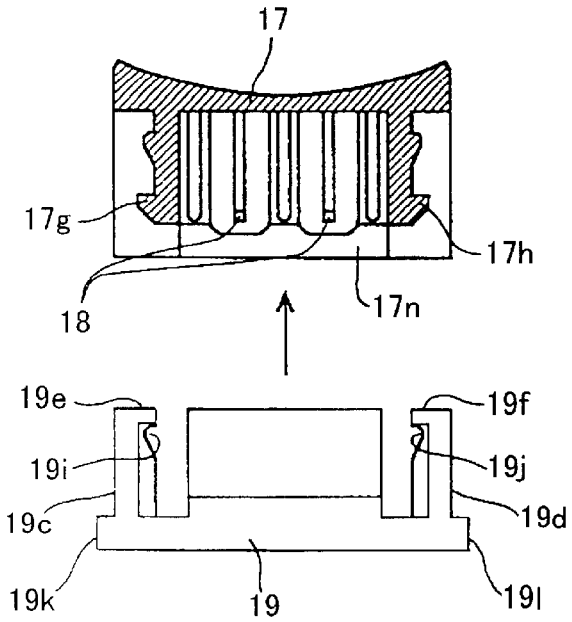
FIGS. 6*a* to 6*c* are sectional plan views showing the inserting operation of the slider.
Figure 6B:
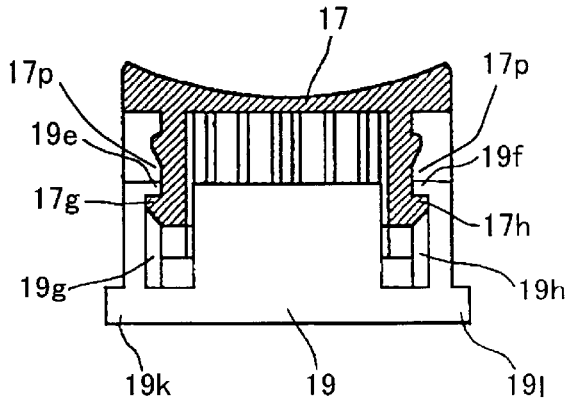

The inserting of the slider 19 is stopped at the substrate introducing position 17*p* shown in FIGS. 3*a* and 6*b* where a gap is formed between the introducing portion 19*b* and the contacting projection 18*a* as shown in FIG. 3*a*.

Thereafter, the flexible substrate 20 is inserted in the connector 17 from the opening 17*n* as shown in FIG. 3*b*. At that time, the flexible substrate 20 is guided by the slant 17*l* and guide ribs 17*k*. The substrate passes through the gap between the introducing portion 19*b* and the contacting projection 18*a*. As shown in FIG. 3*b*, the substrate 20 and the slider 19 are inserted to an innermost position of the connector 17, while the hooks 19*e* and 19*f* of the slider 19 get over the rib projections 17*i* and 17*j*. At the innermost position, the pressure portion 19*a* of the slider 19 presses the substrate 20 to the elastic contacts 18. Consequently, the connecting projections 18*a* of the elastic contacts 18 are contacted with terminals on the flexible substrate 20. Thus, the sound producing device 10 is connected to the flexible substrate 20. At the innermost position, the hooks 19*e* and 19*f* of the slider 19 engage with outside of the rib projections 17*i* and 17*j*, thereby the slider is secured to the connector.

Figure 6C:
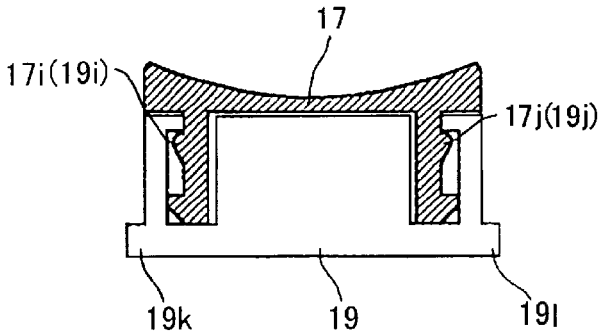
Figure 7:
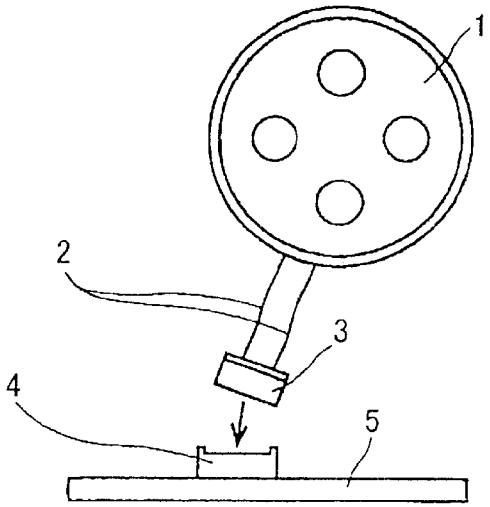
FIG. 7 PRIOR ART
FIGS. 7 to 9 show conventional sound producing devices.
Figure 8:
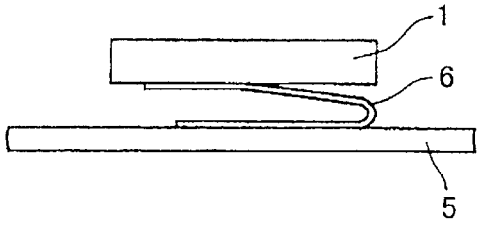
FIG. 8 PRIOR ART
Figure 9:
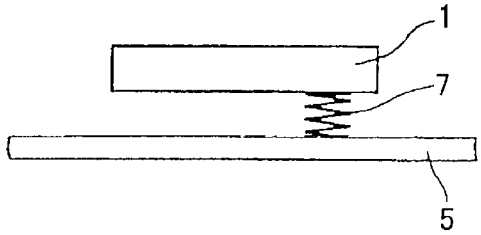
FIG. 9 PRIOR ART

In order to remove the flexible substrate 20, if the slider 19 is pulled out from the position of FIGS. 3*b* and 6*c* to the position of FIGS. 3*a* and 6*b*, the substrate can be removed. At that time, since the hooks 19*e* and 19*f* engage with the hooks 17*g* and 17*h*, the slider 19 is not removed.

In accordance with the present invention, since the substrate is connected to the sound producing device by inserting the substrate in the connector, the connecting operation is very easy.

While the invention has been described in conjunction with preferred specific embodiment thereof, it will be understood that this description is intended to illustrate and not limit the scope of the invention, which is defined by the following claims.

What is claimed is:

1. A sound producing device comprising:

a case;

a connector integral with the case, the connector including an upper plate, lower plate, a pair of side plates between the upper and lower plates, an opening formed by the upper and lower plates and side plates, a hook formed on each of the side plates adjacent the opening, and a projection formed on the side plate at an inner portion thereof;

a pair of elastic contacts projected from the case to the inside of the connector;

a slider inserted in the connector from the opening, the slider having a pressure portion and a pair of side plates formed outside the pressure portion, the pressure portion being provided to press said elastic contacts against terminals of a substrate inserted in the connector from the opening; and an introduction portion adjacent the pressure portion and having an upward slant so as to form a gap for introducing the substrate;

a pair of hooks each of which is formed at a position adjacent a tip end portion of each of the side plates of the slider, so that the hooks slide over the projection of the connector when the slider is inserted in the connector and the slider is held at the inner portion by the projection, and so that the hooks engage with the hooks of the side plates of the connector when the slider is pulled out, thereby preventing the slider from being removed from the connector.

* * * * *